US005147276A

United States Patent [19]

Stäb

[11] Patent Number: 5,147,276

[45] Date of Patent: Sep. 15, 1992

[54] LONGITUDINAL FOLDING DEVICE

[75] Inventor: Rudolf Stäb, Frankenthal, Fed. Rep. of Germany

[73] Assignee: Albert-Frankenthal AG, Wurzburg, Fed. Rep. of Germany

[21] Appl. No.: 719,007

[22] Filed: Jun. 21, 1991

[30] Foreign Application Priority Data

Jun. 30, 1990 [DE] Fed. Rep. of Germany ..... 4020937

[51] Int. Cl.[5] ..... B65H 45/18; B65H 45/22

[52] U.S. Cl. ..... 493/444; 493/435

[58] Field of Search ..... 493/420, 427, 435, 444, 493/445

[56] References Cited

U.S. PATENT DOCUMENTS 3,954,258 5/1976 Skipor et al. ..... 493/445

4,509,939 4/1985 Muller ..... 493/444

FOREIGN PATENT DOCUMENTS 1231723 1/1967 Fed. Rep. of Germany .

2723358 11/1978 Fed. Rep. of Germany .

2837392 2/1980 Fed. Rep. of Germany .

2815077 9/1986 Fed. Rep. of Germany .

2611820 10/1986 Fed. Rep. of Germany .

*Primary Examiner*—William E. Terrell

*Attorney, Agent, or Firm*—Jones, Tullar & Cooper

[57] ABSTRACT

A longitudinal folding device for folding symmetrical and asymmetrical paper products has a folding blade and cooperating folding rollers whose positions with respect to each other can be varied. The folding blade or the folding roller pair can be shifted laterally with respect to a longitudinal fold line. In addition, the spacing between the folding rollers can be adjusted in accordance with paper thickness and number of sheets in the product to be folded.

7 Claims, 4 Drawing Sheets

LONGITUDINAL FOLDING DEVICE

FIELD OF THE INVENTION

The present invention is directed generally to a longitudinal folding device. More particularly, the present invention is directed to a longitudinal folding device for folding paper webs or ribbons. Most specifically, the present invention is directed to a longitudinal folding device having a folding blade and cooperating folding rollers which are laterally shiftable with respect to each other. The folding blade may be moved laterally with respect to the cooperating folding rollers or the rollers may be shifted laterally with respect to the folding blade. In addition, the spacing of the gap or nip between the two cooperating folding rollers may be varied in accordance with the thickness of the product being folded. The longitudinal folding device allows the paper webs or ribbons to be folded more accurately.

DESCRIPTION OF THE PRIOR ART

Longitudinal folding devices are generally known in the art. An example of one such type of folding device is shown in German published, unexamined application No. 2837392. Longitudinal folders of this type are suitable for the production of both symmetrical and asymmetrical folded products. In the production of asymmetrical folded products, the paper web or webs or paper ribbon to be folded are directed past a longitudinal former into an alignment such that the midpoint of the paper web or ribbon is not aligned with the longitudinal former. When the web center is thus out of alignment with the longitudinal former, such as when a third of the paper web width is on one side of the former and two-thirds of the width passes to the other side of the former, there is then produced a longitudinally folded paper ribbon having different width portions on either side of the fold line produced by the longitudinal former. For example, the right part of the web may be two-thirds of the paper web width while the left part of the web may be one-third of the paper web width. This first fold line produced by the longitudinal former is called the former fold.

The longitudinally formed folded paper web or webs may then be cross-cut and cross-folded. These cross-cut and cross-folded products may then be longitudinally folded a second time in a longitudinal folding device. This third fold or second longitudinal fold is typically made along the longitudinal mid-line of the product. Once the now three-folded product has been cut along two edges, there is provided a so-called asymmetrical product which has four pages on one side of the third fold line and eight pages on the other side of the third line.

It has been difficult, when using prior art devices, to form the third fold or so-called second longitudinal fold. This has been particularly the situation where the paper web to be folded consists of several paper ribbons. To facilitate the accurate formation of the second longitudinal fold, the paper web or webs has been provided with a suitable guide line such as a water trace, or has been pre-perforated or has been scored. The need for such folding guides has contributed to the cost and difficulty involved in producing a properly folded product. It will thus be seen that a need exists for a longitudinal folding device which overcomes the limitations of the prior devices and which facilitates the accurate and expeditious folding of paper web products.

SUMMARY OF THE INVENTION

It is an object of the invention to provide a longitudinal folding device.

Another object of the present invention is to provide a longitudinal folding device for forming asymmetrical folded products.

A further object of the present invention is to provide a longitudinal folding device having a relatively shiftable folding blade and folding rollers.

Yet another object of the present invention is to provide a longitudinal folding device in which the spacing between the folding rollers is adjustable.

Still a further object of the present invention is to provide a longitudinal folding device which can operate without water traces, pre-perforation, or scores being required on the paper web.

Even another object of the present invention is to provide a longitudinal folding device that can make accurately folded asymmetrical products.

As will be discussed in greater detail in the description of the preferred embodiments, which are set forth subsequently, the longitudinal folding device of the present invention utilizes either a laterally shiftable folding blade or a laterally shiftable pair of cooperating folding rollers to accurately place the second longitudinal fold in a so-called asymmetrical folded product. Since the second longitudinal fold can be accurately positioned or located by shifting the folding blade or the folding rollers, it is no longer necessary to require a water trace, pre-perforation, or a score line on the paper web, as was the case in prior art devices.

The longitudinal folding device in accordance with the present invention will form the second longitudinal fold line in asymmetrical folded products with greater accuracy than has been possible with prior art devices. This accurate folding may be accomplished even when the sections to be folded were previously longitudinally form folded and cross-cut from several paper webs that were then placed atop each other.

It will be seen that the longitudinal folding device in accordance with the present invention forms longitudinal folds in paper web products in a manner which is superior to prior art devices and is thus a significant advance in the art.

BRIEF DESCRIPTION OF THE DRAWINGS

While the novel features of the longitudinal folding device in accordance with the present invention are set forth with particularity in the appended claims, a full and complete understanding of the invention may be had by referring to the detailed description of the preferred embodiments as are presented subsequently, and as illustrated in the accompanying drawings, in which:

DETAILED DESCRIPTION OF PREFERRED EMBODIMENTS

Figure 1:
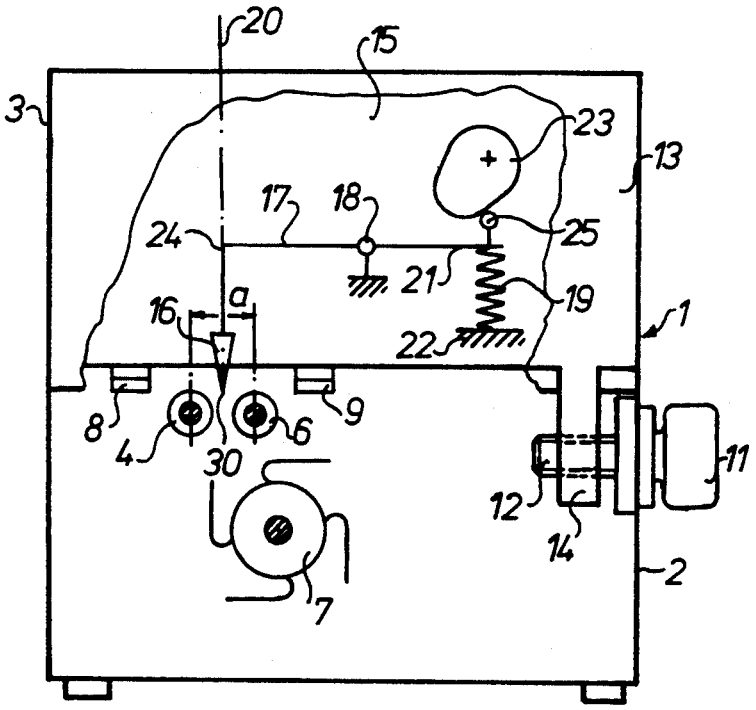
FIG. 1 is a front elevation view of a first preferred embodiment of a longitudinal folding device in accordance with the present invention, in which the longitudinal folding blade is laterally shiftable.

Referring initially to FIG. 1, there may be seen generally at 1 a first preferred embodiment of a longitudinal folding device in accordance with the present invention. In this first preferred embodiment, there is provided a base 2 and a folding blade carrying slide 3. The carrying slide 3 is slidably supported by the base 2 which is, in turn, fixedly positioned on a suitable support surface, such as the ground or the like. In this first embodiment, a longitudinal folding blade 16 is carried by the carrying slide 3 and is shiftable laterally with respect to spaced folding rollers 4 and 6 which are carried by the fixed base 2.

As may be seen in FIG. 1, the spaced paper web folding rollers 4 and 6 extend in the longitudinal direction of paper web travel into the longitudinal folding device 1. A multipart delivery fan 7 is positioned beneath the folding rollers 4 and 6 and spaced, driven conveyor belts 8 and 9 are utilized to bring products to be folded into position beneath the laterally shiftable longitudinal folding blade 16. While the longitudinal folder base 2 will be discussed as being fixed, it will be understood that it could also be laterally shiftable as a unit with the carrying slide 3. Particularly in the situation where the upstream longitudinal folder former is not shiftable, it may be advantageous to move the base 2 and supporting carrying slide 3 laterally to compensate for different width products.

The carrying slide 3 is laterally shiftable with respect to the base 2 in the first preferred embodiment and is supported by suitable dovetail slides or a similar assembly which is not specifically shown in FIG. 1. A front wall portion 13 of the carrying slide 3 carries a downwardly directed compact shoulder 14. This shoulder 14 is provided with a threaded bore 81 that receives a threaded spindle 12 of a gear motor 11 which is secured to the side of the base 2. This gear motor has a high back gear ratio and is reversible in operation. The threaded spindle 81 has a slight pitch angle.

A vertically reciprocable folding blade 16 is positioned between a front wall 13 and a back wall 15 of the carrying slide. This folding blade engages paper products moved into the longitudinal folding device 1 and forms a longitudinal fold in the products as the products are forced into the nip between the folding rollers 4 and 6. Folding blade 16 is supported by a first end of a double-armed driving lever 17 which is, in turn, pivotably supported by a spindle 18 intermediate the ends of lever 17. A compression spring 19 or a torsion bar (not specifically shown) is positioned between a second end 21 of driving lever 17 and a support 22 which is fixed to the frame of carrying slide 3. A driver cam disk 23 is rotated by any suitable means and engages a cam roller 25 that extends upwardly from the second end 21 of the driving lever 17, generally at the same end as, and in opposite direction to the compression spring 19. As the cam disk 23 is caused to rotate, the cam roller 25 will cause the double arm driving lever 17 to pivot about spindle 18, thereby causing the longitudinal folding blade 16 to move vertically up and down with respect to the spaced folding rollers 4 and 6. It will be understood that instead of a cutting blade 16 such as is shown in FIG. 1, there could be used a rotary folding blade, as discussed in German unexamined patent application No. 2723358.

In operation, the gear motor 11 may be operated in either one or the other direction to rotate the threaded spindle 12. Since this spindle 12 is received in the threaded bore 81 in the shoulder 14, the carrying slide 3 may be caused to move laterally in one direction or the other with respect to the relatively fixed base 2. This will move the position of a tip portion 30 of the folding blade 16 with respect to fixed folding rollers 4 and 6. This shifting of the position of blade tip 30 will thus shift the fold line 20 with respect to the folding rollers 4 and 6. The range of movement of blade tip 30 will, of course, be limited by the spacing between the folding rollers 4 and 6. In accordance with the present invention, the range of travel of blade tip 30 may be in the range of about 3 mm in either direction with respect to a zero position which is halfway between the centers of rotation of the folding rollers 4 and 6.

Figure 2:
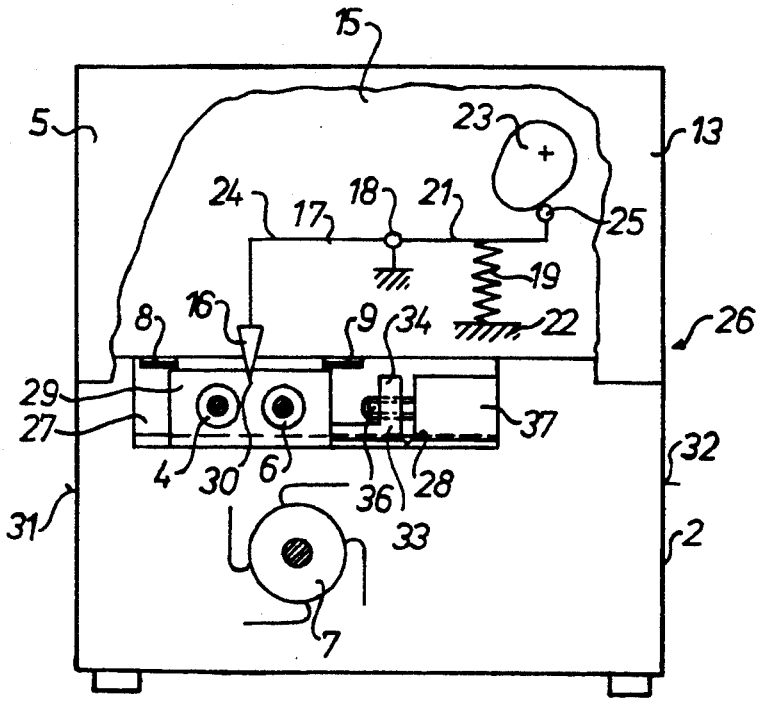
FIG. 2 is a front elevation view of a second preferred embodiment of a longitudinal folding device in accordance with the present invention, in which the folding roller pair is laterally shiftable.

A second preferred embodiment of a longitudinal folding device is shown generally at 26 in FIG. 2. In this second preferred embodiment the base 2 and top assembly 5 are fixed with respect to each other. However, the folding rollers 4 and 6 are shiftable in a recess or receptacle 27 in the base 2 so that their position with respect to the relatively fixed folding blade 16 can be varied.

In this second preferred embodiment 26 of the longitudinal folding device, elements which correspond with similar elements in the first preferred embodiment 1 of FIG. 1 are given corresponding numbers. Thus the product to be folded by folding rollers 4 and 6 are longitudinally folded by vertically reciprocable blade 16 and are removed from infeed conveyor belts 8 and 9 and delivered to a generally known delivery fan 7. The structure used to provide vertical reciprocation of folding blade 16 in the second preferred embodiment 26 of FIG. 2 is the same as the corresponding assembly used in the first preferred embodiment 1 of FIG. 1 and thus will not be again discussed in detail.

The recess or receptacle 27 which is provided in the upper portion of the base 2 has a base surface 28. A generally U-shaped carriage or slide, generally at 29, is supported for lateral horizontal movement with respect to the folding blade 16 on suitable dovetail slides or the like which are not specifically shown. The carriage 29 is thus horizontally shiftable along base surface 28 with respect to left and right side walls 31 and 32, respectively of the base 2 of the second preferred embodiment of the longitudinal folding device. The spaced folding rollers 4 and 6 are rotatably supported between front and rear walls of the generally U-shaped carriage 29. These folding rollers are caused to rotate by any suitable means, not shown. An L-shaped connector 33 has its horizontal leg's free end secured to a right side surface of the U-shaped carriage or slide 29. The vertical leg portion 34 of the L-shaped connector 33 has a threaded bore. This threaded bore receives an externally threaded shaft 36 that is caused to rotate by a gear motor 37. This motor 37 has a high back gear ratio and can be driven in either of two directions of rotation. The gear motor 37 is secured to a right side wall of the receptacle 27. It will thus be seen that the gear motor 37 of the second preferred embodiment can be operated to rotate the threaded shaft 36 and to thus cause the U-shaped carriage or slide 29 to shift laterally in the receptacle 27. This lateral movement of the carriage 29 is effective to move the spaced folding rollers 4 and 6 with respect to the point 30 of the folding blade 16.

Figure 3:
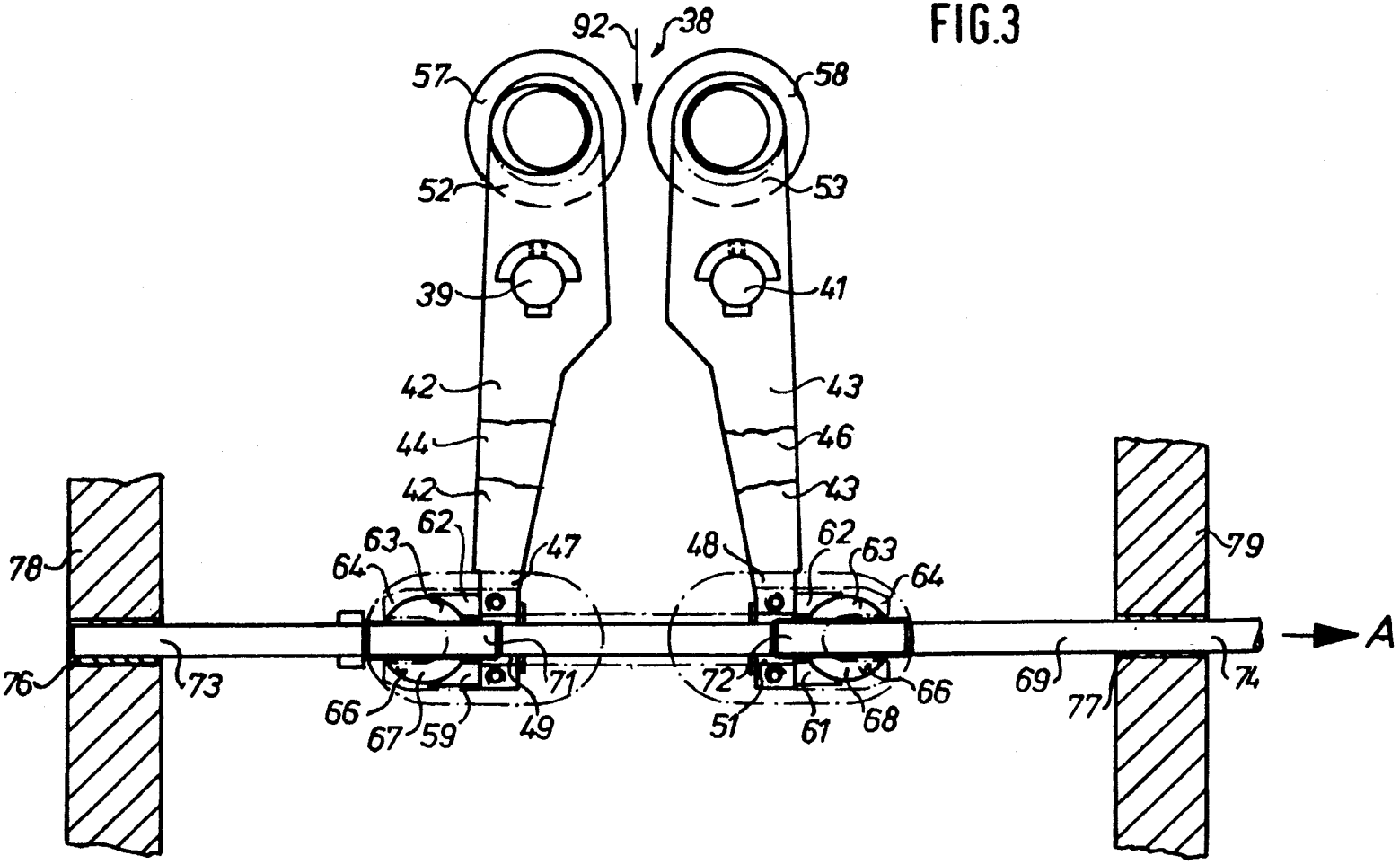
FIG. 3 is a front elevation view of a portion of a third preferred embodiment of a longitudinal folding device in accordance with the present invention and showing a second shiftable folding roller assembly.

Turning now to FIG. 3, there may be seen a portion of a third preferred embodiment of a longitudinal folding device in accordance with the present invention, generally at 38. In this third preferred embodiment 38, the spacing or nip between the two folding rollers 57 and 58 may be adjusted in accordance with the thickness of the product being folded. Additionally, the position of the folding rollers 57 and 58 may be shifted laterally as a unit with respect to a longitudinal folding blade which is not shown in FIG. 3. It will be understood that the assembly 38 depicted in FIG. 3 could be positioned in the recess or receptacle 27 of the base 2 of FIG. 2.

A pair of spaced spindles 39 and 41 are rotatably supported by suitable bearings in front and rear walls (not shown) of the third preferred embodiment 38 of the longitudinal folding device of the present invention. These spindles 39 and 41 are parallel to each other and are arranged at the same height. Their axes are generally parallel to the blade edge of a folding blade with which the folding rollers 57 and 58 cooperate. Each spindle 39 and 41 supports two folding roller support arms with support arms 42 and 44 being supported on spindle 39 and with folding roller support arms 43 and 46 being supported on spindle 41. These folding roller support arms 42, 43, 44 and 46 are pivotably supported by spindles 39 and 41 but are not axially displaceable thereon. The spindles 39 and 41 pass through these support arms 42, 43, 44 and 46 intermediate the ends of the support arms so that each arm has a portion above its support spindle 39 or 41 and a portion below its support spindle. The folding roller support arms 42, 43, 44 and 46 are carried generally near either the front or rear surfaces of the receptacle in which the third preferred embodiment 38 is situated. The axis of rotation of each of the folding roller support arms 42, 43, 44 and 46 is the longitudinal axis of the supporting spindle 39 or 41.

The operation of the folding roller support arms 42, 43, 44 and 46 will now be discussed in detail. For reasons of simplification this discussion will be limited to only the front supporting arms 42 and 43. It will be understood that this discussion is equally appropriate to the rear arms 44 and 46 but will not be repeated therefor. Each pair of support arms 42 and 43, and 44 and 46, can be provided with separately actuable adjusting devices, as will be discussed. It will also be possible to link the two pairs of support arms so that they can be adjusted simultaneously. Lower end portions 47 and 48 of the front supporting arms 42, 43 are each provided with a borehole 49 or 51. These boreholes 49 and 51 are arranged transversely in relation to the boreholes in the supporting arms 42 and 43 in which the spindles 39 and 41 are arranged in bearings. The two folding rollers 42 and 43 are rotatably supported in upper ends 52 and 53 of the folding roller support arms 42 and 43 in a generally conventional manner and are driven for rotation by suitable means, not specifically disclosed.

The lower ends 47 and 48 of the folding roller supporting arms 42 and 43 carry extensions 59 and 61, respectively, that extend to the outside of the arms in the form of a cage for a roll. The extensions 59 and 61 for the lower ends 47 and 48 of the supporting arms 42 and 43 respectively, each form a guide shoe. Each extension 59 and 61 consists of a base 62 with a semi-circular recess 63. The recess 63 has, at its inner point, a passing borehole. On each base 62, there is carried a cage 64 which is screwed to the lower end 47 or 48 of the supporting arms 42 or 43. The cage 64 has a convex semicircular shape at its inner side and also has a passing, enlarged borehole which passes through it. The recess 63 of the base 62 and the semicircular surfaces 66 of the cages 64 cooperate to receive a roll 67 or 68 in such a way that these rolls 67 or 68 are movable. These rolls 67 and 68 are made of metal and each has a threaded tap hole passing therethrough. The roll 67 is supported in the left extension 54 while the roll 68 is supported in the right extension 61. The tap hole of the left roll 67 has a left-hand thread while the tap hole of the right roll 68 has a right-hand thread. Both rolls 67 and 68 are flattened laterally , extending parallel to the tap hole.

As may be further seen in FIG. 3, a thread spindle 69 which passes through and is engaged with the tap holes in both the rolls 67 and 68 is provided. Thread spindle 69 has a left outside screw thread piece 71 which has a left-hand thread that is in engagement with the internal thread of the left roll 67. Thread spindle 69 further has a right outside screw thread piece 72 which has a right-hand thread and which is in engagement with the internal thread of the right roll 68. The thread spindle 69 is supported for rotation and axial movement by plain ends 73 and 74 that pass through bearing frames 76 and 7 which are supported in side frames 78 and 79, as may also be seen in FIG. 3.

Figure 4:
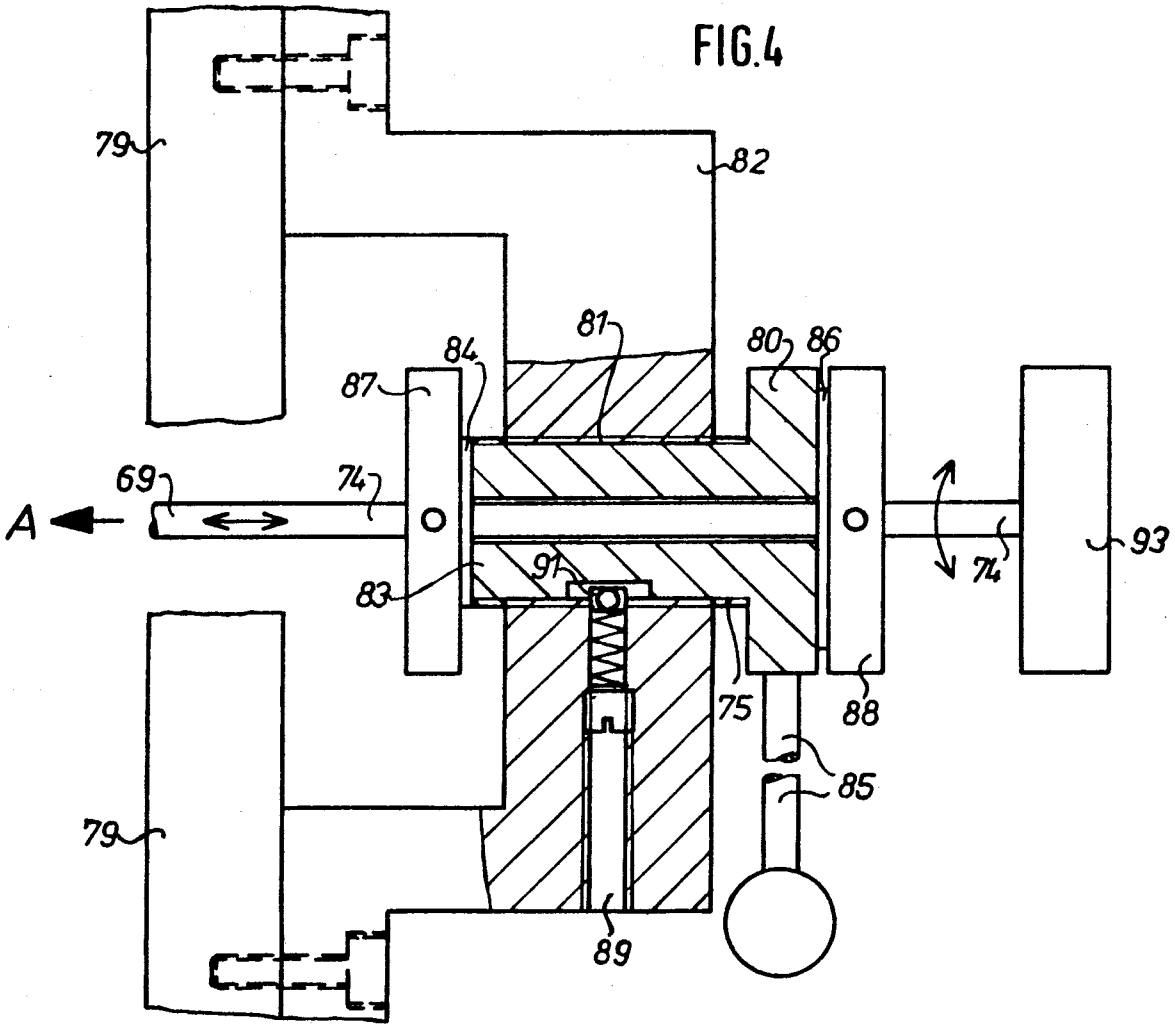
FIG. 4 is a top plan view of a device for adjusting the folding rollers of the third preferred embodiment.

Referring now to FIG. 4 in conjunction with FIG. 3, the right plain end 74 of the spindle 69 passes through a tapped hole 81 of a bow support 82. Ends of the bow support 82 are secured by suitable bolts or the like to the outside surface of the right side frame 79. A generally elongated cylindrical bushing 83 is screwed into the tap hole 81. A collar 80, that does not carry internal screw threads, is integrally formed on the right side of bushing 83. An adjusting lever 85 is attached to this collar 80. Movement of the lever 85 will thereby effect rotation of the bushing 83 in the tapped hole 81.

A right, plain end 74 of the spindle 69 is guided through a plain internal borehole formed at the center of bushing 83. The outside diameter of the plain end 74 of spindle 69 is a little smaller than the internal diameter of the integral borehole of the bushing 83. The externally threaded surface of the bushing 83 is longer, in accordance with the needed adjusting distance, than the thickness of the bow 82 at the position of the tap hole 81. A thin disc 84 or 86 is positioned adjacent the right and left ends of the front surfaces of the bushing 83 on the end 74 of the spindle 69. Adjacent each of the discs 84 and 86, there is arranged a ring 87 or 88 on the spindle 69 and this ring is rigidly secured to the spindle 69. The bushing 83 is provided around its circumference with a number of axially extending index grooves, each having approximately the length of the adjusting distance, and which are positioned an equal circumferential distance from each other. One or more index bolts 91 are each arranged in a corresponding partially threaded borehole 89 in the bow 82. Each of these index bolts 91 has an inner end which is received in one of the index grooves in the bushing 83. The circumferential spacing between the index grooves is selected so that a rotation of the bushing 83 through use of the adjusting lever through a circumferential distance between two adjacent index grooves will effect an adjustment of both of the folding rollers 57 and 58 by a distance of, for example, 0.04 mm eccentrically with respect to a fold 92. As the bushing 83 is rotated in the threaded tap hole 81, the entire spindle 69 will be shifted horizontally to the left or to the right. This shifting will, in turn, cause both of the folding roller support arms 42 and 43 to pivot about the spindles 39 and 41 in the same direction, through the same angle. This causes a lateral shifting of the two folding rollers 57 and 58 with respect to the line of action 92 of the vertically reciprocable folding blade 16. The spacing between the two folding rollers 57 and 58 is not varied during the lateral shifting.

A handwheel 93 is secured to the right end of the spindle 69, as may be seen in FIG. 4. Rotation of the handwheel 93 will cause spindle 69 to rotate with respect to the bushing 83 since the central passage in the bushing 83 is larger than the spindle 69. The spindle can be rotated in either a clockwise or counterclockwise direction by actuation of the handwheel 93. A suitable mechanical position indicator, of a generally conventional type, can be used to indicate the amount that the handwheel 93 has been turned. The handwheel 93 can, for example, operate according to the pendulum system, and can be equipped with a position indicator, having no special linkage with the machine body and which is only slid on the end of the spindle 69 ;and is attached on the same. A weight is provided in the position indicators of such systems and which runs over a fine bearing on the pointer shaft and which is always adjusted downwards by the force of gravity, when the handwheel 93 is rotated.

Rotation of the handwheel 93 causes the spindle 69 to rotate in the same direction. The externally threaded members 71 and 72, which are attached to the spindle, will rotate in the meshing tap holes of the rolls 67 and 68. This rotation of the threaded members 71 and 72 is thus translated into transverse linear motion of the rolls 67 and 68 and through the extensions 59 and 61 into movement of the folding roller support arms 42 and 43. Since the thread directions of the threaded members 71 and 72 are opposite to each other, the folding roller support arms will move in opposing directions about their support spindles 39 and 41. Thus the spacing between the folding rollers 57 and 58 will either be decreased or increased by rotation of the handwheel 93. In the embodiment of the invention depicted in FIG. 3 a rotation of the handwheel 93 and hence the spindle 69 in a clockwise direction will reduce the spacing between the folding rollers 57 and 58. If the spindle 69 is turned in a counterclockwise direction, the spacing between the folding rollers 57 and 58 will be increased. The third embodiment thus allows the two separate adjustments or movements of the folding rollers 57 and 58 to be accomplished independently of each other. The spacing between the rollers can be either increased or decreased, depending on the thickness of the product to be folded. In a completely independent manner, the position of the folding rollers as a unit can be shifted laterally with respect to the line of action 90 of the vertically reciprocable folding blade 16.

The third preferred embodiment of the longitudinal folding device in accordance with the present invention is particularly suited to automatic operation of the folding roller adjustment procedure. An operator could enter the paper thickness and the number of pages in the product to be folded into a suitable control device, such as a computer. Using this data, the control device would determine the amount of rotation and translation of spindle 69 which would be necessary to properly locate and space the folding rollers 57 and 58. The appropriate values could be then transmitted to signal amplifiers which would then drive stepper motors to rotate the spindle 69 and the bushing 83. In such a configuration, the collar 80 on the bushing 83 could be provided with an exterior gear ring. In a similar manner, the handwheel 93 would be replaced by a pinion gear. A pinion gear of each of two stepper motors would engage either the gear ring on the collar 83 or the pinion which would have been substituted for the handwheel 93. As discussed above, these stepper motors would be controlled to rotate in accordance with values that are determined by the paper thickness and the number of sheets in the stack to be folded. The number of executed steps of each of the stepper motors can be added up and stored so that the current position of either the spindle 69 or the bushing 83 at any time can be readily ascertained. The positions of the spindle and bushing can then be utilized to ascertain the spacing between the folding rollers 57 and 58 as well as their lateral position with respect to the fold application line 92.

While preferred embodiments of a longitudinal folding device in accordance with the present invention have been fully and completely set forth hereinabove, it will be apparent to one of skill in the art that a number of changes in, for example, the type of delivery fan used, the type of conveying assembly provided, the specific shape of the folding blade, the means to rotate the folding rollers, and the like may be made without departing from the true spirit and scope of the present invention, which is accordingly to be limited only by the following claims.

What is claimed is:

1. A longitudinal folding device usable to longitudinally fold sections of paper webs, said longitudinal folding device comprising:

a vertically reciprocable folding blade engageable with the sections of paper webs;

a first driven folding roller and a second driven folding roller, said first and second driven folding rollers forming a pair of spaced driven folding rollers cooperable with said folding blade and receiving the sections of paper webs from said folding blades;

a first pair of spaced double arm levers having first and second ends and being pivotable about a first fixed pivot axis intermediate said first and second ends, and a second pair of spaced double arm levers having first and second ends and being pivotable about a second fixed pivot axis intermediate said first and second ends;

means for rotatably supporting said first folding roller between said first ends of said first pair of spaced double arm levers and means for rotatably supporting said second folding roller between said first ends of said second pair of opposed double arm levers; and means for selectively laterally shifting said pair of spaced driven rollers with respect to said folding blade and for varying a spacing distance between said first driven folding roller and said second driven folding roller in said pair of spaced driven folding rollers.

2. The longitudinal folding device of claim 1 wherein said second end of each said spaced double arm lever in each said first and second pairs of spaced double arm levers is operably connected to a rotatable and translatable spindle and further wherein each said spindle is rotatable to vary said spacing distance between said first and second rollers in said pair of folding rollers and is translatable to effect said lateral shifting of said pair of spaced driven folding rollers with respect to said folding blade.

3. The longitudinal folding device of claim 2 wherein an externally threaded bushing is positioned in a tapped hole in a frame portion of said longitudinal folding device and receives each said spindle in a central bore and wherein each said spindle is freely rotatable in said central bore of its cooperating bushing and is constrained from sliding motion with respect to said cooperating bushing and further wherein a first adjustment means is provided for each said cooperating bushing and a second adjustment means is provided for each said spindle.

4. The longitudinal folding device of claim 3 further including an index assembly for controlling the rotation of each said bushing in each said tapped hole.

5. A longitudinal folding device usable to longitudinally fold sections of paper webs, said longitudinal folding device comprising:

a vertically reciprocable folding blade engageable with the sections of paper webs;

a pair of spaced driven folding rollers cooperable with said folding blade and receiving the sections of paper webs from said folding blade; and means for supporting each said folding roller in said pair of folding rollers for pivotable movement with respect to a fixed pivot axis, said supporting means comprising first and second pairs of spaced double arm levers, each said folding roller being rotatably supported between first ends of one of said first and second pairs of spaced double arm levers, second ends of each said spaced double arm lever in each said pair of spaced double arm levers being operably connected to a rotatable to vary a spacing distance between said pair of folding rollers and is translatable to laterally shift said pair of folding rollers with respect to said folding blade.

6. The longitudinal folding device of claim 5 wherein an externally threaded bushing is positioned in a tapped hole in a frame portion of said longitudinal folding device and receives said spindle in a central bore and wherein said spindle is freely rotatable in said central bore and is constrained from sliding motion with respect to said bushing and further wherein a first adjustment means is provided for said bushing and a second adjustment means is provided for said spindle.

7. The longitudinal folding device of claim 6 further including an index assembly for controlling the rotation of said bushing in said tapped hole.

* * * * *

UNITED STATES PATENT AND TRADEMARK OFFICE

CERTIFICATE OF CORRECTION

PATENT NO. : 5,147,276

DATED : September 15, 1992

INVENTOR(S) : Rudolf Stäb

It is certified that error appears in the above-identified patent and that said Letters Patent is hereby corrected as shown below:

Column 8, line 54, after "driven" insert --folding--.

Column 10, line 8, after "rotatable" insert --and translatable spindle and further wherein said spindle is rotatable--.

Signed and Sealed this

Seventh Day of September, 1993

Bruce Lehman

*Attest:*

BRUCE LEHMAN

*Attesting Officer*

*Commissioner of Patents and Trademarks*